US011644031B2

(12) United States Patent
Ohmori et al.

(10) Patent No.: US 11,644,031 B2
(45) Date of Patent: May 9, 2023

(54) VANE PUMP WITH TIP-END-SIDE GUIDE SURFACES PROVIDED BETWEEN INNER AND OUTER NOTCHES OF THE DISCHARGE PORT AND BASE-END-SIDE GUIDE SURFACE PROVIDED IN THE BACK PRESSURE PORT

(71) Applicant: KYB Corporation, Tokyo (JP)

(72) Inventors: Yusuke Ohmori, Gifu (JP); Tomoyuki Nakagawa, Gifu (JP); Masamichi Sugihara, Gifu (JP); Atsumi Takahashi, Gifu (JP); Satoshi Watanabe, Gifu (JP)

(73) Assignee: KYB CORPORATION, Tokyo (JP)

( * ) Notice: Subject to any disclaimer, the term of this patent is extended or adjusted under 35 U.S.C. 154(b) by 119 days.

(21) Appl. No.: 17/283,668

(22) PCT Filed: Oct. 29, 2019

(86) PCT No.: PCT/JP2019/042378
§ 371 (c)(1),
(2) Date: Apr. 8, 2021

(87) PCT Pub. No.: WO2020/090817
PCT Pub. Date: May 7, 2020

(65) Prior Publication Data

US 2022/0010795 A1 Jan. 13, 2022

(30) Foreign Application Priority Data

Nov. 1, 2018 (JP) ..... JP2018-206815

(51) Int. Cl.
*F04C 2/344* (2006.01)
*F04C 14/04* (2006.01)
(Continued)

(52) U.S. Cl.
CPC ..... *F04C 2/3446* (2013.01); *F01C 21/108* (2013.01); *F04C 14/04* (2013.01);
(Continued)

(58) Field of Classification Search
CPC ..... F01C 21/108; F04C 2/3446; F04C 14/04; F04C 15/06; F04C 2240/30; F04C 2250/102
See application file for complete search history.

(56) References Cited

U.S. PATENT DOCUMENTS

2011/0165010 A1* 7/2011 Iijima ..... F01C 21/108 418/269
2015/0377236 A1 12/2015 Shimono et al.

FOREIGN PATENT DOCUMENTS

JP 2001-280263 A 10/2001
JP 2006-090261 A 4/2006
JP 2014-163307 A 9/2014

* cited by examiner

*Primary Examiner* — Mary Davis
(74) *Attorney, Agent, or Firm* — Rabin & Berdo, P.C.

(57) ABSTRACT

A vane pump includes: a rotor; vanes freely slidably received in the rotor; a cam ring having a cam face with which the vanes come into sliding contact; a side member having a sliding contact surface with which side surfaces of the rotor and the vanes come into sliding contact; pump chambers; and a discharge port configured to guide working fluid discharged from the pump chambers. The side member has a guide surface that is provided on an end portion side of the opening portion, the guide surface being configured to push the end portions of the vanes upward and guide them toward the sliding contact surface of the side member as the rotor is rotated in the reverse rotation direction.

10 Claims, 12 Drawing Sheets

(51) Int. Cl.
*F01C 21/10* (2006.01)
*F04C 15/06* (2006.01)

(52) U.S. Cl.
CPC ..... *F04C 15/06* (2013.01); *F04C 2240/30* (2013.01); *F04C 2250/102* (2013.01)

VANE PUMP WITH TIP-END-SIDE GUIDE SURFACES PROVIDED BETWEEN INNER AND OUTER NOTCHES OF THE DISCHARGE PORT AND BASE-END-SIDE GUIDE SURFACE PROVIDED IN THE BACK PRESSURE PORT

TECHNICAL FIELD

The present invention relates to a vane pump.

BACKGROUND ART

JP2014-163307A discloses a vane pump provided with a rotor having a plurality of slits formed in a radiating pattern, vanes that are respectively freely slidably received in the slits, a cam ring having a cam face with which tip end portions of the vanes are brought into sliding contact, and a side member having a sliding contact surface with which side surface of the rotor is brought into sliding contact. In the vane pump disclosed in JP2014-163307A, discharge ports and back pressure ports are formed so as to serve as opening portions that open in the sliding contact surface of the side member.

Working fluid discharged from pump chambers that are defined between the rotor, the cam ring, and adjacent vanes is guided to the discharge ports. A part of the working fluid that has been guided to the discharge ports is guided through the back pressure ports to back pressure chambers provided on the base-end sides of the slits. The vanes are respectively pushed by the pressure in the back pressure chambers in the direction in which the vanes project out from the slits and are brought into sliding contact with the cam face.

SUMMARY OF INVENTION

The vane pump may be reverse rotated depending on its application embodiment. When the vane pump is reverse rotated, because the working fluid is not sufficiently supplied to the discharge ports and the back pressure ports, a state in which the vanes are not sufficiently pushed by the pressure in the back pressure chambers is established.

Thus, when the vane pump is reverse rotated, the vanes are separated away from the cam face. Because small gaps are formed between the vanes and the side member, if the vanes are separated away from the cam face, the vanes are inclined so as to fall down towards the side member, and there is a risk in that the tip end portion of the vane drops into the discharge port (the opening portion) and/or the base-end portion of the vane drops into the back pressure port (the opening portion). If the end portion of the vane drops into the opening portion that opens in the sliding contact surface of the side member, there is a risk in that the end portion of the vane moves within the opening portion along with the reverse rotation of the rotor and the end portion of the vane comes to hit an end portion of the opening portion, thereby causing the side member to be damaged.

An object of the present invention is to prevent the side member from being damaged.

According to one aspect of the present invention, a vane pump includes: a rotor having a plurality of slits formed in a radiating pattern, the rotor being rotationally driven; a plurality of vanes freely slidably received in the slits; a cam ring having a cam face with which tip end portions of the vanes come into sliding contact; a side member having a sliding contact surface with which side surfaces of the rotor and the vanes come into sliding contact; pump chambers defined by the rotor, the cam ring, and the adjacent vanes; a suction port configured to open in the sliding contact surface, the suction port being configured to guide working fluid to be sucked into the pump chambers; a discharge port configured to open in the sliding contact surface, the discharge port being configured to guide the working fluid discharged from the pump chambers; groove-shaped notches provided in the side member so as to extend from an end portion of the discharge port in a direction opposite from a forward rotation direction of the rotor; and back pressure chambers defined with base-end portions of the vanes in the slits. The notches includes: an inner notch located at an inner side of the end portion of the discharge port in a radial direction; and an outer notch located at an outer side of the end portion of the discharge port in the radial direction, and the side member has a tip-end-side guide surface provided between the inner notch and the outer notch so as to be continuous from the end portion of the discharge port, the tip-end-side guide surface being configured to push the tip end portions of the vanes upward and guides them toward the sliding contact surface of the side member when the rotor is rotated in a reverse rotation direction.

According to another aspect of the present invention, a vane pump comprising: a rotor having a plurality of slits formed in a radiating pattern, the rotor being rotationally driven; a plurality of vanes freely slidably received in the slits; a cam ring having a cam face with which tip end portions of the vanes come into sliding contact; a side member having a sliding contact surface with which side surfaces of the rotor and the vanes come into sliding contact; pump chambers defined by the rotor, the cam ring, and the adjacent vanes; a suction port configured to open in the sliding contact surface, the suction port being configured to guide working fluid to be sucked into the pump chambers; a discharge port configured to open in the sliding contact surface, the discharge port being configured to guide the working fluid discharged from the pump chambers; and back pressure chambers defined with base-end portions of the vanes in the slits. The side member has: a back pressure port configured to open in the sliding contact surface, the back pressure port being configured to communicate with the back pressure chambers; and a base-end-side guide surface provided on an end portion side of the back pressure port on a communication commencing side where the communication with the back pressure chambers commences as the rotor is forward rotated, the base-end-side guide surface being configured to push the base-end portions of the vanes upward and guide them toward the sliding contact surface of the side member as the rotor is rotated in a reverse rotation direction.

DESCRIPTION OF EMBODIMENTS

A vane pump 100 according to an embodiment of the present invention will be described with reference to the drawings.

The vane pump 100 is used as a fluid pressure source for a fluid pressure apparatus, such as, for example, a transmission, a power steering apparatus, and so forth that is mounted on vehicles and industrial machineries. In this embodiment, the fixed displacement vane pump 100 using working oil as working fluid will be described. The vane pump 100 may also be a variable displacement vane pump.

Figure 1:
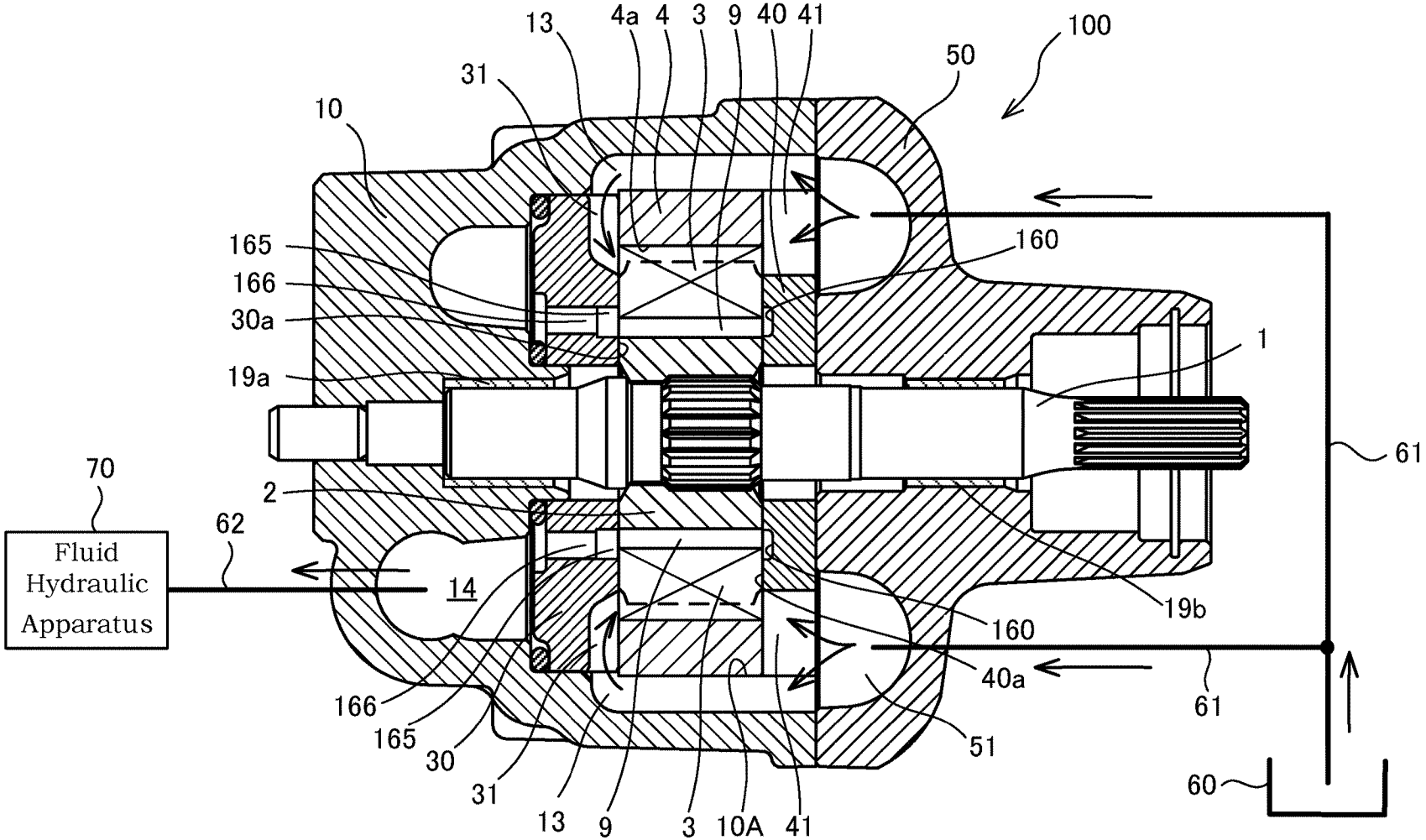
FIG. 1 is a sectional view of a vane pump according to an embodiment of the present invention.
Figure 2:
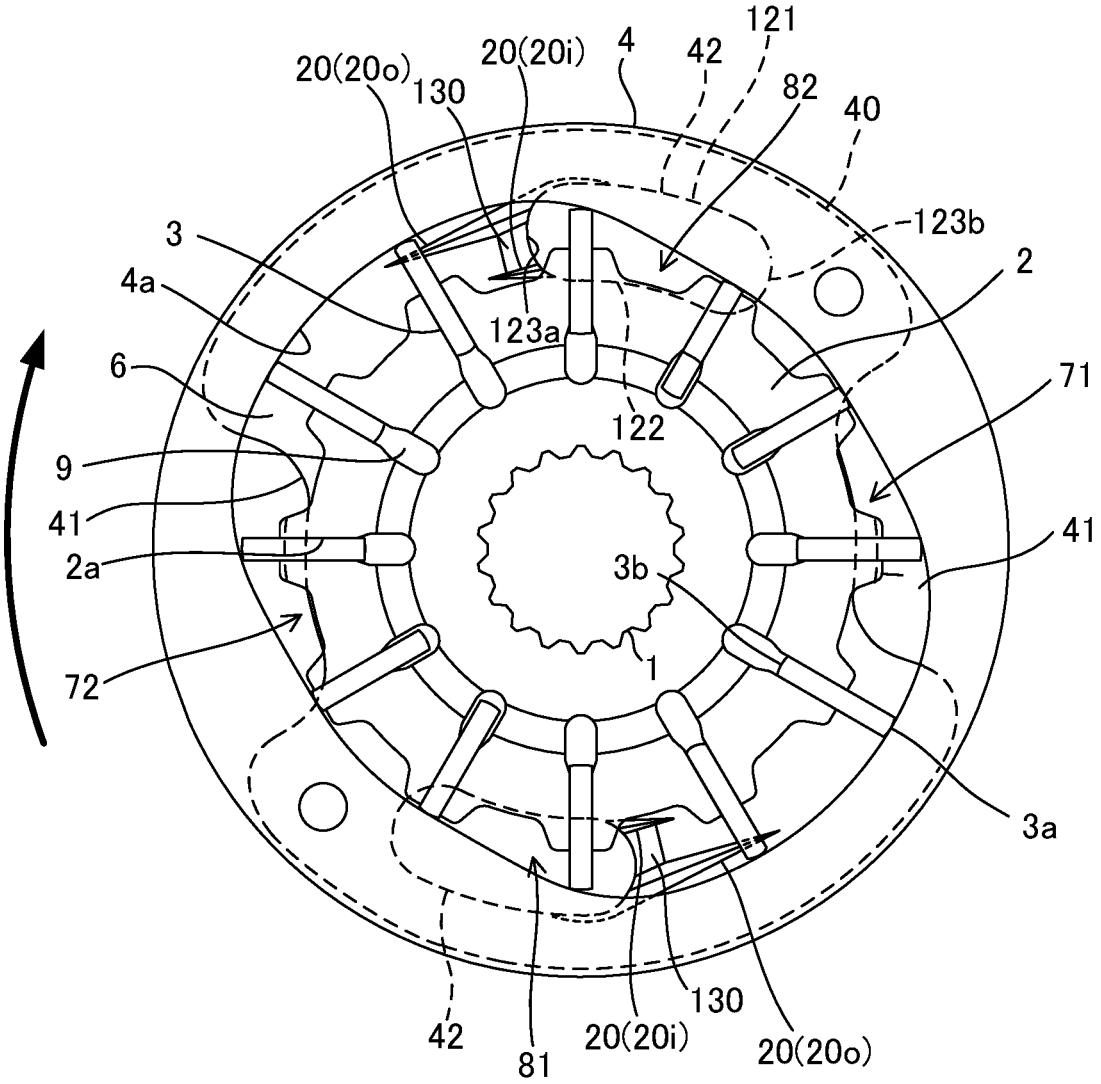
FIG. 2 is a side view of a rotor, a cam ring, and a cover-side side plate of the vane pump according to the embodiment of the present invention.

FIG. 1 is a sectional view of the vane pump 100, and FIG. 2 is a side view of a rotor 2, a cam ring 4, and a cover-side side plate 40. As shown in FIGS. 1 and 2, the vane pump 100 is provided with: a pump body 10 that is formed with a pump accommodating concave portion 10A; a pump cover 50 that is fixed to the pump body 10 so as to cover an opening portion of the pump accommodating concave portion 10A; a driving shaft 1 that is rotatably supported by the pump body 10 and the pump cover 50 via bearings 19*a* and 19*b*; the rotor 2 that is linked with the driving shaft 1 and accommodated in the pump accommodating concave portion 10A; vanes 3 that are respectively freely slidably received in slits 2*a* of the rotor 2; and the cam ring 4 that accommodates the rotor 2 and the vanes 3 and that has a cam face (an inner circumferential surface) 4*a* with which tip end portions 3*a* of the vanes 3 come into sliding contact.

The vane pump 100 is driven by a driving device (not shown), for example an engine, etc., and thereby, the rotor 2 linked to the driving shaft 1 is rotationally driven in the clockwise direction (forward rotation) as shown by an arrow in FIG. 2 to generate the fluid pressure.

A plurality of slits 2*a* are formed in a radiating pattern in the rotor 2. The slits 2*a* respectively open on an outer circumference of the rotor 2.

The vanes 3 are inserted into the respective slits 2*a* so as to be freely slidably, and has the tip end portions 3*a* that are end portions in the direction projecting out from the slits 2*a* and base-end portions 3*b* that are end portions at the opposite side of the tip end portions 3*a*. In the slits 2*a*, back pressure chambers 9 are respectively defined on the bottom portion side of the slits 2A with the base-end portions 3*b* of the vanes 3. The working oil serving as the working fluid is guided to the back pressure chambers 9 from a high-pressure chamber 14, which will be described below. The vanes 3 are respectively pushed by the pressure in the back pressure chambers 9 in the direction in which the vanes 3 project out from the slits 2*a*.

The cam ring 4 is an annular member having the cam face 4*a* forming an inner circumferential surface having a substantially oval shape. As the vanes 3 are pushed by the pressure in the back pressure chambers 9 in the direction in which the vanes 3 project out from the slits 2*a*, the tip end portions 3*a* of the vanes 3 are brought into sliding contact with the cam face 4*a* of the cam ring 4. With such a configuration, pump chambers 6 are defined in the cam ring 4 by an outer circumferential surface of the rotor 2, the cam face 4*a* of the cam ring 4, and the adjacent vanes 3.

Because the cam face 4*a* of the cam ring 4 has the substantially oval shape, as the rotor 2 is rotated, the displacement of each of the pump chambers 6, which are defined by the respective vanes 3 in sliding contact with the cam face 4*a*, is repeatedly expanded and contracted. The working oil is sucked in suction regions in which the pump chambers 6 are expanded, and the working oil is discharged in discharge regions in which the pump chambers 6 are contracted.

As shown in FIG. 2, the vane pump 100 has a first suction region 71 and a first discharge region 81, in which the vanes 3 undergo first reciprocating movement, and a second suction region 72 and a second discharge region 82, in which the vanes 3 undergo second reciprocating movement. While the rotor 2 completes a full rotation, the pump chambers 6 are expanded in the first suction region 71, contracted in the first discharge region 81, expanded in the second suction region 72, and contracted in the second discharge region 82. Although the vane pump 100 has two suction regions 71 and 72 and two discharge regions 81 and 82, the configuration is not limited thereto, and the vane pump 100 may have a configuration in which a single suction region or three or more suction regions and a single discharge region or three or more discharge regions are provided.

As shown in FIG. 1, the vane pump 100 is further provided with a body-side side plate 30 and a cover-side side plate 40. The body-side side plate 30 serves as a first side member that is provided on one end side of the rotor 2 in the axial direction and that comes into contact with one-side surfaces of the rotor 2 and the cam ring 4, and the cover-side side plate 40 serves as a second side member that is provided on the other end side of the rotor 2 in the axial direction and that comes into contact with other-side surfaces of the rotor 2 and the cam ring 4.

The body-side side plate 30 is provided between a bottom surface of the pump accommodating concave portion 10A and the rotor 2. First end surfaces of the rotor 2 and the vanes 3 in the axial direction come into sliding contact with the body-side side plate 30, and a first end surface of the cam ring 4 in the axial direction comes into contact with the body-side side plate 30. In other words, an end surface of the body-side side plate 30 functions as a sliding contact surface 30*a* with which the side surfaces of the rotor 2 and the vanes 3 come into sliding contact. The cover-side side plate 40 is provided between the rotor 2 and the pump cover 50. Second end surfaces of the rotor 2 and the vanes 3 in the axial direction come into sliding contact with the cover-side side plate 40, and a second end surface of the cam ring 4 in the axial direction comes into contact with the cover-side side plate 40. In other words, an end surface of the cover-side side plate 40 functions as a sliding contact surface 40*a* with which the side surfaces of the rotor 2 and the vanes 3 come into sliding contact. By being configured as described above, the body-side side plate 30 and the cover-side side plate 40 are arranged in a state in which they respectively face both side surfaces of the rotor 2 and the cam ring 4.

The body-side side plate 30, the rotor 2, the cam ring 4, and the cover-side side plate 40 are accommodated in the pump accommodating concave portion 10A of the pump body 10. By attaching the pump cover 50 to the pump body 10 in this state, the pump accommodating concave portion 10A is sealed.

An annular high-pressure chamber 14 is defined by the pump body 10 and the body-side side plate 30 on the bottom surface side of the pump accommodating concave portion 10A of the pump body 10. The high-pressure chamber 14 communicates with a fluid hydraulic apparatus 70 provided outside the vane pump 100 via a discharge passage 62.

The pump cover 50 is formed with a suction pressure chamber 51 and bypass passages 13 that communicates with the suction pressure chamber 51 is formed in an inner circumferential surface of the pump accommodating concave portion 10A. The bypass passages 13 are respectively provided at two positions that oppose to each other such that the cam ring 4 is located therebetween. The suction pressure chamber 51 is connected to a tank 60 via suction passages 61.

Figure 3:
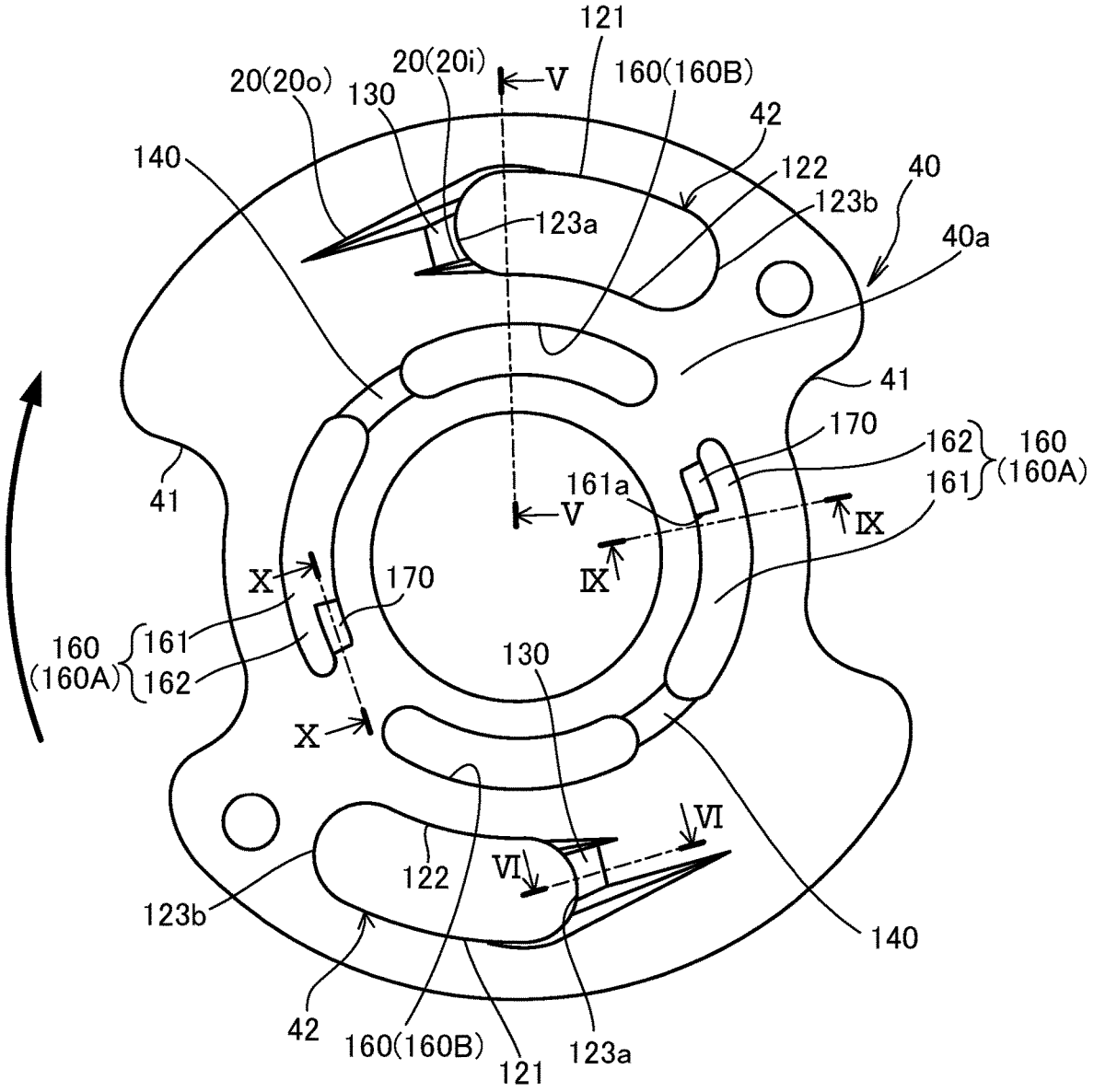
FIG. 3 is a side view of the cover-side side plate of the vane pump according to the embodiment of the present invention.

FIG. 3 is a side view of the cover-side side plate 40. As shown in FIG. 3, the cover-side side plate 40 is a disc-shaped member having two suction ports 41 that guide the working oil to be sucked into the pump chambers 6 and two discharge ports 42 that guide the working oil discharged from the pump chambers 6.

The suction ports 41 are formed so as to open in the sliding contact surface 40*a* correspondingly to the suction regions 71 and 72 (see FIG. 2). Each of the suction ports 41 is formed such that a part of an outer edge portion of the cover-side side plate 40 is cut away. As shown in FIG. 1, the suction ports 41 of the cover-side side plate 40 communicate with suction ports 31 of the body-side side plate 30 via the bypass passages 13 of the pump body 10. Therefore, the working oil sucked from the suction passages 61 is guided to the pump chambers 6 through the suction ports 31 of the body-side side plate 30 and the suction ports 41 of the cover-side side plate 40.

As shown in FIG. 3, the discharge ports 42 are formed as arc-shaped grooves so as to open in the sliding contact surface 40*a* correspondingly to the discharge regions 81 and 82 (see FIG. 2), and the working oil in the pump chambers 6 is discharged to the high-pressure chamber 14. In the sliding contact surface 40*a* of the cover-side side plate 40, groove-shaped notches 20 are formed so as to communicate with end portions of the discharge ports 42. The notches 20 will be described below in detail.

The cover-side side plate 40 is formed with four back pressure ports 160 that open in the sliding contact surface 40*a* and communicate with the back pressure chambers 9. Back pressure ports 160A provided in the first suction region 71 and back pressure ports 160B provided in the first discharge region 81 are connected with each other at their end portions via communicating grooves 140, and they are communicated with each other via the communicating grooves 140. Similarly, the back pressure ports 160A provided in the second suction region 72 and the back pressure ports 160B provided in the second discharge region 82 are connected with each other at their end portions via the communicating grooves 140, and they are communicated with each other via the communicating grooves 140.

Relative rotation of the cam ring 4 and the cover-side side plate 40 is restricted by two positioning pins (not shown). With such a configuration, the suction ports 41 and the discharge ports 42 of the cover-side side plate 40 are aligned with respect to the suction regions 71 and 72 and the discharge regions 81 and 82.

As shown in FIG. 1, similarly to the cover-side side plate 40, the body-side side plate 30 is a disc-shaped member having the suction ports 31 that are formed so as to respectively correspond to the suction regions 71 and 72 and discharge ports (not shown) that are formed so as to respectively correspond to the discharge regions 81 and 82.

The suction ports 31 are formed at positions that correspond to the bypass passages 13 of the pump accommodating concave portion 10A. Each of the suction ports 31 is formed to have a concaved shape that opens radially outward. Each of the suction ports 31 extends such that its outer circumference end reaches an outer circumferential surface of the body-side side plate 30. The working oil is supplied to the suction ports 31 via the suction pressure chamber 51 and the bypass passages 13 (see FIG. 1). The suction ports 31 guide the thus supplied working oil into the pump chambers 6.

The discharge ports (not shown) of the body-side side plate 30 are each formed to have an arc shape by penetrating therethrough and are in communication with the high-pressure chamber 14 formed in the pump body 10. These discharge ports discharge the working oil that has been guided from the pump chambers 6 to the high-pressure chamber 14.

The sliding contact surface 30*a* of the body-side side plate 30 is formed with back pressure ports 165 that are formed so at to oppose to the back pressure ports 160 of the above-described cover-side side plate 40. The back pressure ports 165 are in communication with the high-pressure chamber 14 via back pressure passages 166.

As the engine is driven and the driving shaft 1 is rotated, the rotor 2 linked to the driving shaft 1 is rotated. As a result, each of the pump chambers 6 in the cam ring 4 sucks the working oil through the suction ports 31 of the body-side side plate 30 and the suction ports 41 of the cover-side side plate 40 and discharges the working oil to the high-pressure chamber 14 through the discharge ports (not shown) of the body-side side plate 30 and the discharge ports 42 of the cover-side side plate 40. The working oil that has entered the high-pressure chamber 14 is then supplied through the discharge passage 62 to the fluid pressure apparatus 70 provided outside the vane pump 100 (see FIG. 1). As described above, each of the pump chambers 6 in the cam ring 4 supplies/discharges the working oil by the expansion/contraction caused along with the rotation of the rotor 2.

Figure 4:
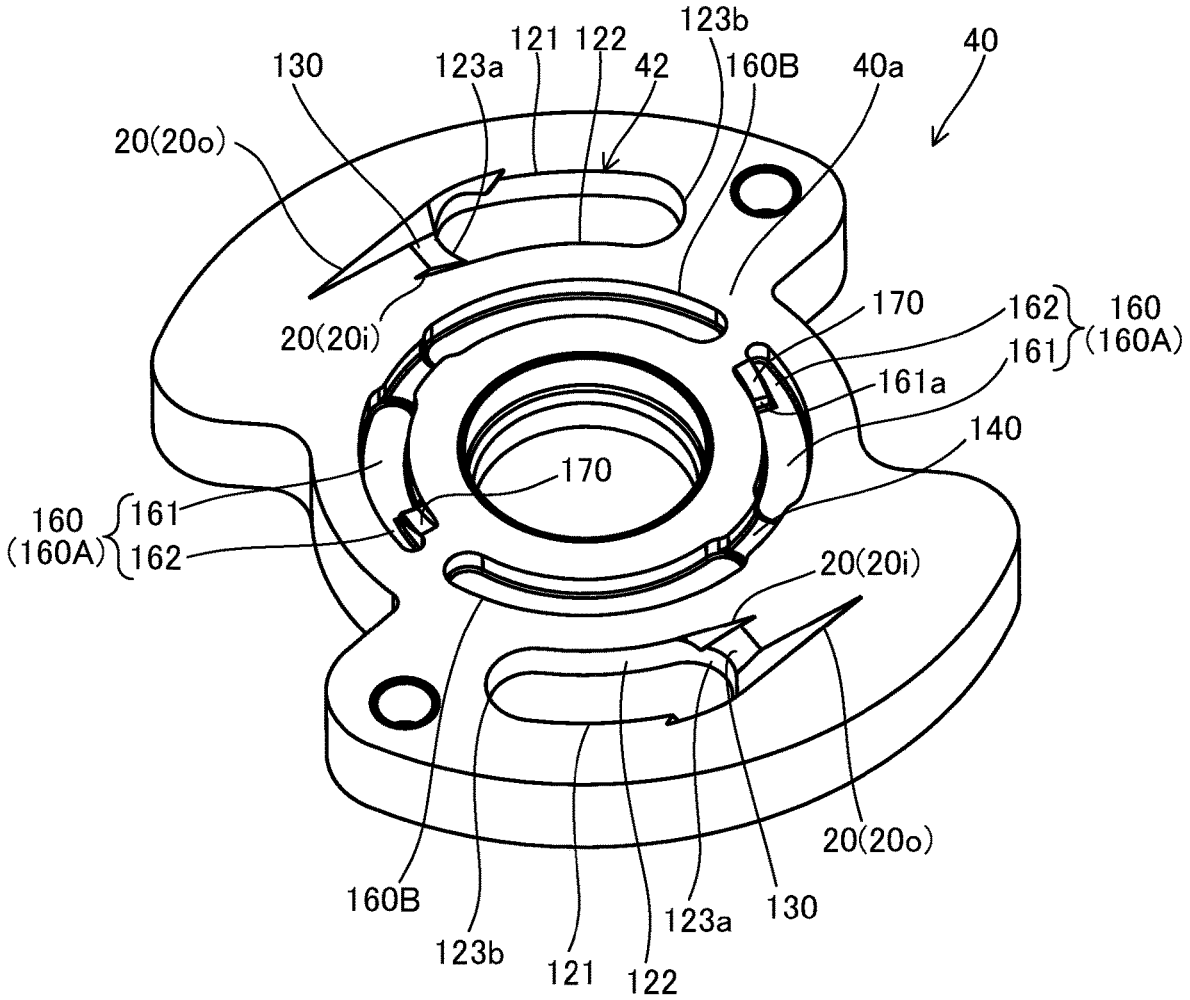
FIG. 4 is a perspective view of the cover-side side plate of the vane pump according to the embodiment of the present invention.
Figure 5:
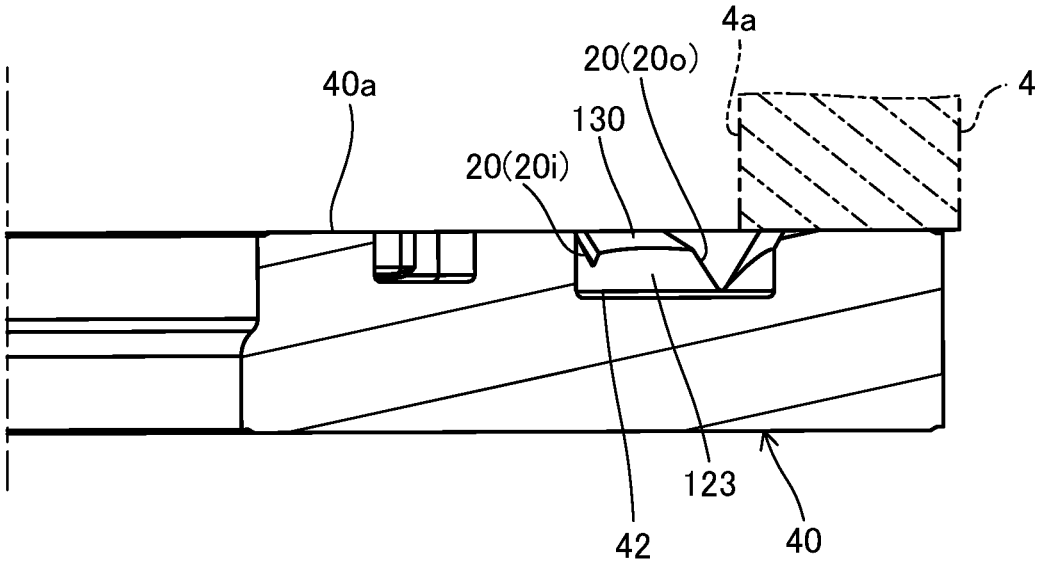
FIG. 5 is a sectional view taken along a line V-V in FIG. 3.

Next, the notches 20 that are formed in the sliding contact surface 40*a* of the cover-side side plate 40 will be described in detail below with reference to FIGS. 2 to 5. FIG. 4 is a perspective view of the cover-side side plate 40, and FIG. 5 is a sectional view taken along a line V-V in FIG. 3. As shown in FIGS. 2 to 5, in this embodiment, the cover-side side plate 40 has, as the notches 20, inner notches 20*i* and outer notches 20*o* that are respectively provided on the outside of the inner notches 20*i* in the radial direction.

The outer notches 20*o* and the inner notches 20*i* are provided in the sliding contact surface 40*a* of the cover-side side plate 40 so as to respectively correspond to the two discharge ports 42. Each of the discharge ports 42 has: an outer arc portion 121 and an inner arc portion 122 that are formed to have an arc shape extending along the circumferential direction of the rotor 2; and arc-shaped end-portion-side arc portions 123*a* and 123*b* that connect the outer arc portion 121 and the inner arc portion 122. The inner arc portion 122 is provided on the inside of the outer arc portion 121 in the radial direction so as to oppose the outer arc portion 121. The outer notch 20*o* and the inner notch 20*i* communicate with the discharge port 42 by being provided on the end-portion-side arc portion 123*a* that is an end portion of the discharge port 42 in the circumferential direction on the communication commencing side where the communication between the discharge port 42 and the pump chambers 6 commences as the rotor 2 is forward rotated.

The outer notch 20*o* and the inner notch 20*i* are each formed to have a groove shape that extends in the direction opposite from the forward rotation direction of the rotor 2 from the end-portion-side arc portion 123*a* that is the end portion of the discharge port 42 such that an opening area is gradually reduced towards the direction opposite from the forward rotation direction of the rotor 2. In the above, the opening area of the notch 20 refers to a cross-sectional area of the notch 20 in a plane along the radial direction of the rotor 2. The outer notch 20*o* is arranged on the outer circumferential side of the inner notch 20*i*. In other words, the inner notch 20*i* is located at the inner side of the end-portion-side arc portion 123*a* of the discharge port 42 in the radial direction, and the outer notch 20*o* is located at the outer side of the end-portion-side arc portion 123*a* of the discharge ports 42 in the radial direction. The outer notch 20*o* is formed such that the length along the rotation direction of the rotor 2 (the circumferential direction) is longer than that of the inner notch 20*i*.

The notch 20 presents a triangle shape having two straight lines extending linearly from a apex towards the discharge port 42 when viewed from the axial direction of the rotor 2 (see FIG. 3). In the notch 20, a cross-sectional shape is formed to have a V-shape in the plane along the radial direction of the rotor 2 (see FIG. 5). In addition, the groove of the notch 20 is formed such that its depth is increased gradually towards the forward rotation direction of the rotor 2.

As the pump chambers 6 communicate with the notch 20 by the forward rotation of the rotor 2; the adjacent pump chambers 6 communicate with each other through the notch 20. Thereby, the high-pressure working oil from the discharge port 42 is guided from the pump chamber 6 on the forward side in the rotation direction to the pump chamber 6 on the rearward side in the rotation direction. Thus, the pressure in the pump chamber 6 on the rearward side in the rotation direction is gradually increased even before the pump chamber 6 communicates directly with the discharge port 42, and therefore, a sudden pressure change when the pump chamber 6 communicates directly with the discharge port 42 is suppressed.

The outer notch 20*o* is formed so as to extend along the outer arc portion 121, and the inner notch 20*i* is formed so as to extend along the inner arc portion 122. The outer notch 20*o* is formed such that the opening edge portion of the outer notch 20*o* on the radially outer side of the base-end side (the discharge port 42 side) is located at the outside of the outer arc portion 121 in the radial direction. In other words, the outer notch 20*o* is formed so as to include a boundary portion between the outer arc portion 121 and the end-portion-side arc portion 123*a*.

Furthermore, as shown in FIGS. 2 and 5, the outer notch 20*o* is formed such that, on the base-end side (the discharge port 42 side), the opening edge portion thereof on radially outer side is located at the outside of the cam face 4*a* of the cam ring 4 in the radial direction. In other words, the cam face 4*a* is located at the radially inside of the opening edge portion of the outer notches 20*o* on the radially outer side of the base-end side. Thus, a part of the base-end side of the outer notch 20*o* on the outer side in the radial direction is covered by the cam ring 4.

An operation of the vane pump 100 will be described with reference to FIGS. 1 and 2.

As the driving shaft 1 is rotationally driven by a motive force from the driving device such as the engine, etc. (not shown), the rotor 2 is forward rotated in the direction shown by the arrow in FIG. 2. As the rotor 2 is forward rotated, the pump chambers 6 positioned in the suction regions 71 and 72 are expanded. Thereby, the working oil in the tank 60 is sucked into the pump chambers 6 through the suction passages 61 and the suction ports 31 and 41. In addition, as the rotor 2 is forward rotated, the pump chambers 6 positioned in the discharge regions 81 and 82 are contracted. Thereby, the working oil in the pump chambers 6 is discharged to the high-pressure chamber 14 through the discharge ports 42. The working oil that has been discharged to the high-pressure chamber 14 is then supplied to the external fluid pressure apparatus 70 through the discharge passage 62. In the vane pump 100 according to this embodiment, as the rotor 2 completes a full rotation, the respective pump chambers 6 repeat the suction and discharge of the working oil twice.

A part of the working oil that discharged to the high-pressure chamber 14 is supplied to the back pressure chambers 9 through the back pressure passages 166 and the back pressure ports 165, 160A, and 160B, and thereby, the base-end portions 3*b* of the vanes 3 are pushed radially outward. Therefore, the vanes 3 are biased in the direction in which the vanes 3 project out from the slits 2*a* by a fluid pressure force from the back pressure chambers 9 pushing the base-end portions 3*b* and by a centrifugal force caused by the rotation of the rotor 2. With such a configuration, because the tip end portions 3*a* of the vanes 3 rotate while coming into sliding contact with the cam face 4*a* of the cam ring 4, the working oil in the pump chambers 6 is guided to the discharge ports 42 without leaking out from between the tip end portions 3*a* of the vanes 3 and the cam face 4*a* of the cam ring 4.

As described above, when the rotor 2 is forward rotated, the working oil that has been sucked to the pump chambers 6 from the suction ports 31 and 41 is pressurized by the contraction of the pump chambers 6 and is discharged from the discharge ports 42. In addition, the part of the working oil in the discharge ports 42 is guided to the back pressure chambers 9, and the vanes 3 are pushed against the cam face 4*a* by the pressure in the back pressure chambers 9.

However, the vane pump 100 may be reverse rotated depending on its application embodiment. When the vane pump 100 is reverse rotated, because the working fluid is not sufficiently supplied to the discharge ports 42 and the back pressure ports 160 and 165, a state in which the vanes 3 are not sufficiently pushed by the pressure in the back pressure chambers 9 is established.

Thus, when the vane pump 100 is reverse rotated, the vane 3 is separated away from the cam face 4*a*. Because small gaps are formed between the vane 3 and the pair of side plates 30 and 40, if the vane 3 is separated away from the cam face 4*a*, the vane 3 is inclined so as to fall down towards the side plates 30 or 40, and there is a risk in that the tip end portion 3*a* of the vane 3 drops into the discharge port (the opening portion) 42 and/or the base-end portion 3*b* of the vane 3 drops into the back pressure port (the opening portion) 160 or 165. If the end portion of the vane 3 drops into the opening portion that opens in the sliding contact surface 30*a* or 40*a* of the side plate 30 or 40, there is a risk in that the end portion of the vane 3 moves within the opening portion along with the reverse rotation of the rotor 2 and the end portion of the vane 3 comes to hit the end portion of the opening portion, thereby causing the side plate 30 or 40 to be damaged. If the side plate 30 or 40 is damaged, fine metal pieces are formed, and there is a risk in that the vane pump 100 is broken due to the metal pieces bitten between the sliding contact surfaces 30*a* and 40*a* and the rotor 2.

Thus, in this embodiment, the side plates 30 and 40 are respectively provided with guide surfaces (tip-end-side guide surfaces 130 and base-end-side guide surfaces 170) with which, even in a case in which the end portion of the vane 3 (the tip end portion 3*a* or the base-end portion 3*b*) drops into the opening portion (the discharge port 42, or the back pressure port 165, 160) that opens in the sliding contact surface 30*a*, 40*a*, the dropped end portion of the vane 3 (the tip end portion 3*a* or the base-end portion 3*b*) is pushed upward and guided to the sliding contact surface 30*a*, 40*a*. Because the guide surfaces provided in the body-side side plate 30 and the guide surfaces provided in the cover-side side plate 40 have the same configuration, a representative description will be given on the guide surfaces provided in the cover-side side plate 40 in the following, and description of the guide surfaces provided in the body-side side plate 30 will be omitted.

Figure 6:
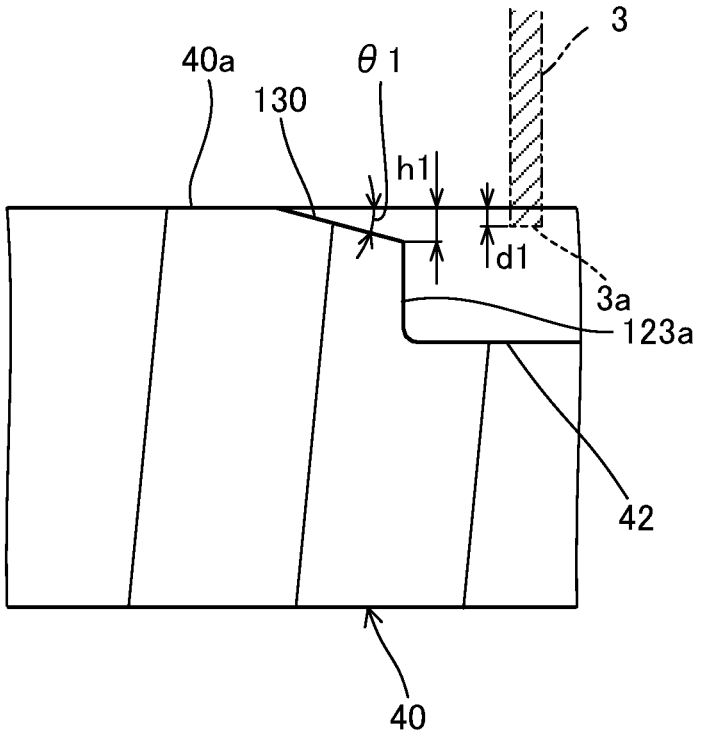
FIG. 6 is a sectional view taken along a line VI-VI in FIG. 3.

The tip-end-side guide surfaces 130 that are provided correspondingly to the discharge ports 42 will be described in detail with reference to FIGS. 3 to 6. FIG. 6 is a sectional view taken along a line VI-VI in FIG. 3. As shown in FIGS. 3 to 6, the tip-end-side guide surface 130 is formed between the inner notch 20*i* and the outer notch 20*o* so as to be continuous from the end-portion-side arc portion 123*a* of the discharge port 42. The tip-end-side guide surface 130 is a flat surface that pushes the tip end portion 3*a* of the vane 3 upward and guides it toward the sliding contact surface 40*a* of the cover-side side plate 40 as the rotor 2 is rotated in the reverse rotation direction.

The tip-end-side guide surface 130 is connected to the inner notch 20*i* and the outer notch 20*o*. A length of the tip-end-side guide surface 130 in the circumferential direction is shorter than the lengths of the outer notch 20*o* and the inner notch 20*i* in the circumferential direction. Thus, a tip end of the outer notch 20*o* and a tip end of the inner notch 20*i* are located away from the tip-end-side guide surface 130 by a predetermined distance in the direction opposite from the forward rotation direction.

As shown in FIG. 6, the end-portion-side arc portion 123*a* of the discharge port 42 is provided so as to be parallel with the rotation axis of the rotor 2. The end-portion-side arc portion 123*a* of the discharge port 42 is formed so as to be erected perpendicularly upward from a bottom surface of the discharge port 42. The tip-end-side guide surface 130 is formed to have a tapered shape in which the depth from the sliding contact surface 40*a* (the distance to the sliding contact surface 40*a* in the axial direction) is decreased in the reverse rotation direction of the rotor 2. The tip-end-side guide surface 130 is linearly inclined toward the sliding contact surface 40*a* of the cover-side side plate 40 from an end portion of the end-portion-side arc portion 123*a* on the opposite side of the bottom surface, in other words the end portion of the end-portion-side arc portion 123*a* on the sliding contact surface 40*a* side (an upper end portion in the figure). The tip-end-side guide surface 130 may be a tapered surface that is linearly inclined toward the sliding contact surface 40*a* from the end surface on the opposite side from the sliding contact surface 40*a* (the bottom surface of the discharge port 42).

An axial direction distance h1 from a corner portion that forms the boundary between the end-portion-side arc portion 123*a* and the tip-end-side guide surface 130 (in other words, the upper end portion of the end-portion-side arc portion 123*a* in the figure) to the sliding contact surface 40*a* is set so as to be greater than a maximum drop depth d1 of the vane 3 (in other words, the distance in the axial direction from the sliding contact surface 40*a* to the tip end portion 3*a* of the vane 3 that has dropped at the greatest extent) (h1>d1). For the tip-end-side guide surface 130, it is preferable that an inclined angle θ1 relative to the sliding contact surface 40*a* be set so as to be greater than 0° and smaller than 45°.

Figure 7A:
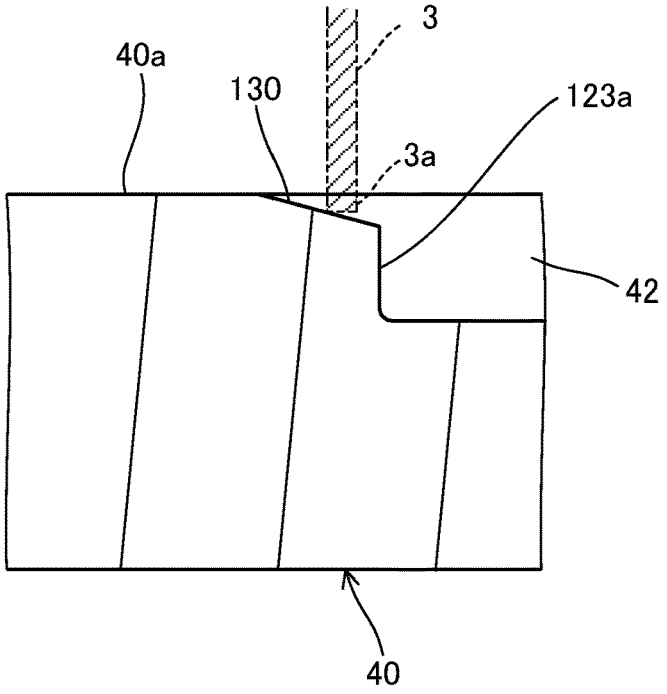
FIG. 7A is a diagram showing a state in which a tip end portion of a vane is in contact with a tip-end-side guide surface.
Figure 7B:
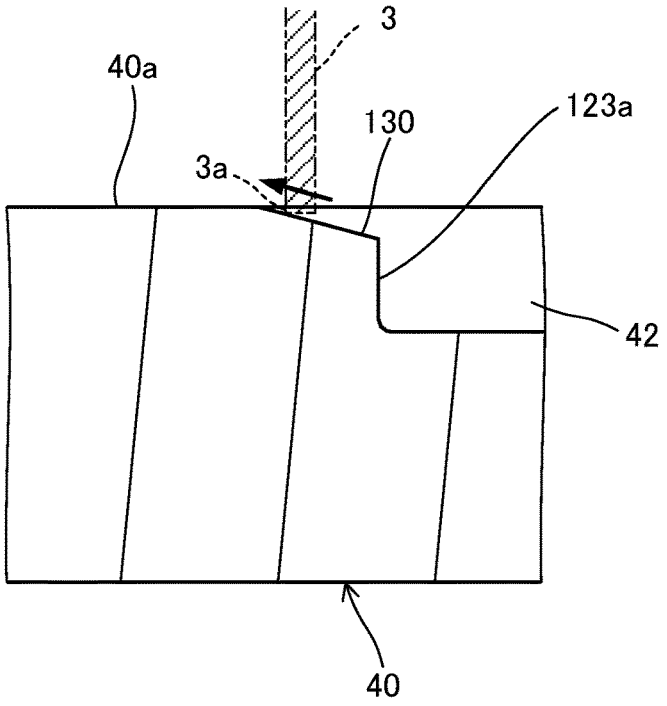
FIG. 7B is a diagram showing a state in which the tip end portion of the vane moves along the tip-end-side guide surface.

Therefore, in a case in which the tip end portion 3*a* of the vane 3 has dropped into the discharge port 42 when the vane pump 100 is reverse rotated, as shown in FIG. 7A, the tip end portion 3*a* of the vane 3 comes into contact with the tip-end-side guide surface 130. As shown in FIG. 7B, together with the movement of the vane 3 in the circumferential direction, the tip end portion 3*a* of the vane 3 that has come into contact with the tip-end-side guide surface 130 moves while being in sliding contact with the tip-end-side guide surface 130. Because the tip end portion 3*a* of the vane 3 is pushed upward by the tip-end-side guide surface 130, the inclination of the vane 3 is gradually corrected and the tip end portion 3*a* is guided to the sliding contact surface 40*a*. Because the tip-end-side guide surface 130 is formed to have the tapered shape, the inclination of the vane 3 is corrected smoothly as the rotor 2 is reverse rotated.

Furthermore, the tip-end-side guide surface 130 is linearly inclined. Thus, compared with a case in which the tip-end-side guide surface 130 is inclined so as to be curved, a sliding resistance of the tip end portion 3*a* of the vane 3 moving along the tip-end-side guide surface 130 can be made constant, and so, it is possible to stably guide the tip end portion 3*a* of the vane 3 to the sliding contact surface 40*a* of the cover-side side plate 40.

In a case in which the tip-end-side guide surface 130 is not provided, the tip end portion 3*a* of the vane 3 hits the end-portion-side arc portion 123*a* that is a side wall perpendicularly erected from the bottom surface of the discharge port 42, and therefore, there is a risk of damage to the end-portion-side arc portion 123*a*, such as chipping on the end-portion-side arc portion 123*a*. In contrast, in this embodiment, the tip end portion 3*a* of the vane 3 comes to contact with the tip-end-side guide surface 130 and is guided to the sliding contact surface 40*a*, and therefore, it is possible to prevent the discharge port 42 from being damaged.

Figure 8A:
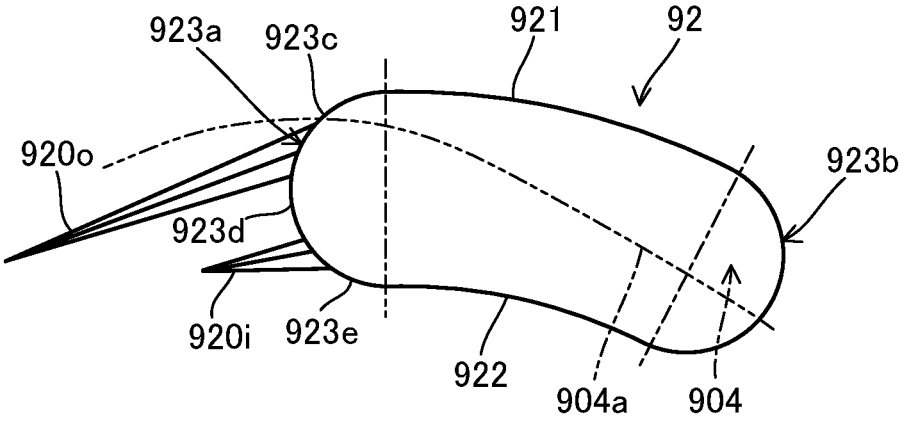
FIG. 8A is a diagram showing a discharge port, notches, and the cam ring of the vane pump according to a comparative example of this embodiment.
Figure 8B:
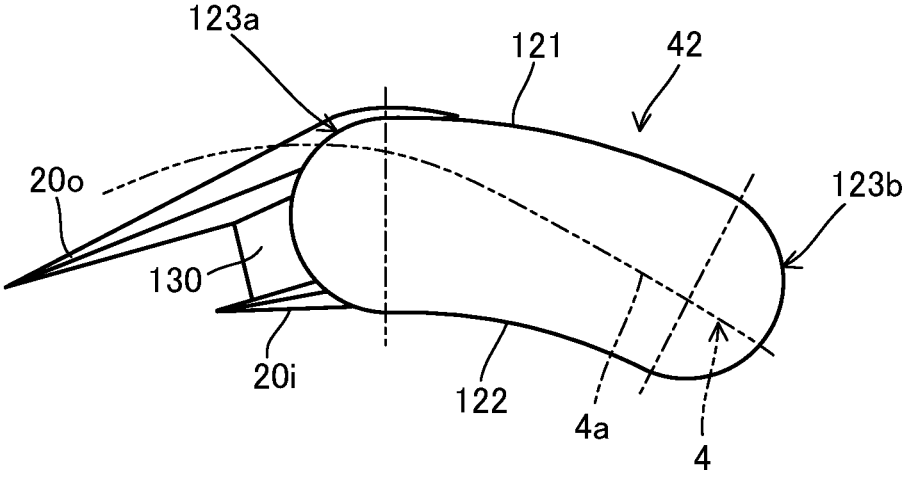
FIG. 8B is a diagram showing the discharge port, the notches, and the cam ring of the vane pump according to this embodiment.

Operational advantages that are achieved by employing the configuration according to this embodiment will be described with a comparison with a comparative example. FIG. 8A is a schematic view showing a discharge port 92, notches 920*i* and 920*o*, and a cam ring 904 of a vane pump according to the comparative example of this embodiment, and FIG. 8B is a schematic view showing the discharge ports 42, the notches 20*i* and 20*o*, and the cam ring 4 of the vane pump 100 according to this embodiment. In the figures, the cam rings 904 and 4 are shown by two-dot chain lines.

As shown in FIG. 8A, the discharge port 92 has: an outer arc portion 921 and an inner arc portion 922 that are formed to have an arc shape extending along the circumferential direction of the rotor 2; and arc-shaped end-portion-side arc portions 923*a* and 923*b* that connect the outer arc portion 921 and the inner arc portion 922. The inner arc portion 922 is provided on the inner side of the outer arc portion 921 in the radial direction so as to oppose the outer arc portion 921.

The outer notch 920*o* and the inner notch 920*i* extend in the circumferential direction from the end-portion-side arc portion 923*a*. An outer end portion 923*c* that is a part of the end-portion-side arc portion 923*a* is provided between the outer notch 920*o* and the outer arc portion 921, a center end portion 923*d* that is a part of the end-portion-side arc portion 923*a* is provided between the outer notch 920*o* and the inner notch 920*i*, and an inner end portion 923*e* that is a part of the end-portion-side arc portion 923*a* is provided between the inner notch 920*i* and the inner arc portion 922. In addition, the outer notch 920*o* is formed such that, on the base-end side (the discharge port 92 side), the opening edge portion thereof on radially outer side is located at the radially inside of a cam face 904*a* of the cam ring 904.

Thus, in the comparative example according to this embodiment, in a case in which the vane pump is reverse rotated and the tip end portion 3*a* of the vane 3 has dropped into the discharge port 92, there is a risk in that the tip end portion 3*a* of the vane 3 hits any of the outer end portion 923*c*, the center end portion 923*d*, and the inner end portion 923*e* and the side plate is damaged. The drop depth of the tip end portion 3*a* of the vane 3 on the outer side in the radial direction tends to be larger than that of the tip end portion 3*a* of the vane 3 on the inner side in the radial direction.

In contrast, in this embodiment, as shown in FIG. 8B, the outer notch 20*o* is formed such that the opening edge portion of the outer notch 20*o* on the radially outer side of the base-end side is located at the outside of the outer arc portion 121 in the radial direction. In other words, the outer notch 20*o* is formed so as to include the boundary portion between the outer arc portion 121 and the end-portion-side arc portion 123*a*. Thus, the tip end portion 3*a* of the vane 3 that has dropped into the discharge port 42 is prevented from hitting the side wall of the discharge port 42 on the outside of the outer notch 20*o* in the radial direction.

Figure 9:
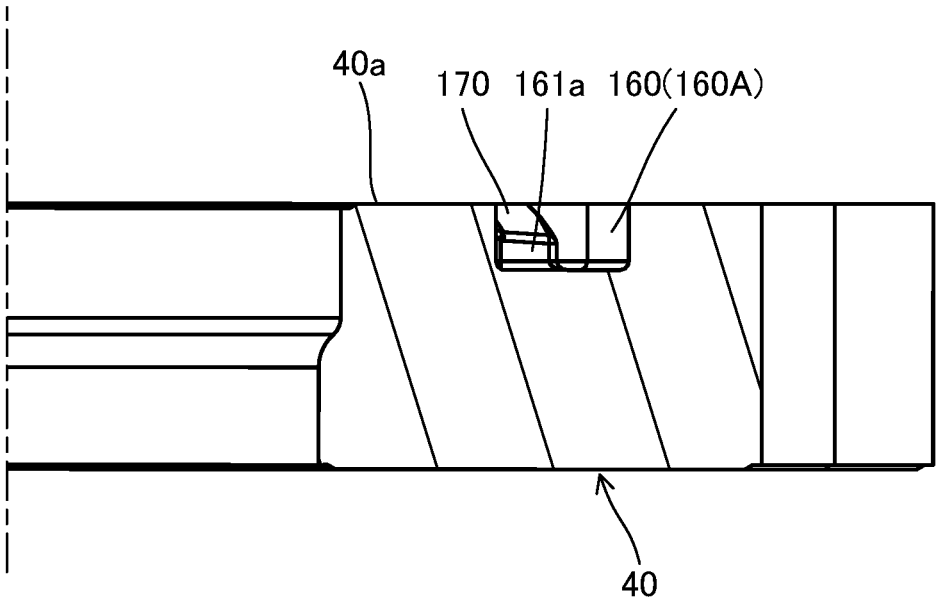
FIG. 9 is a sectional view taken along a line IX-IX in FIG. 3.
Figure 10:
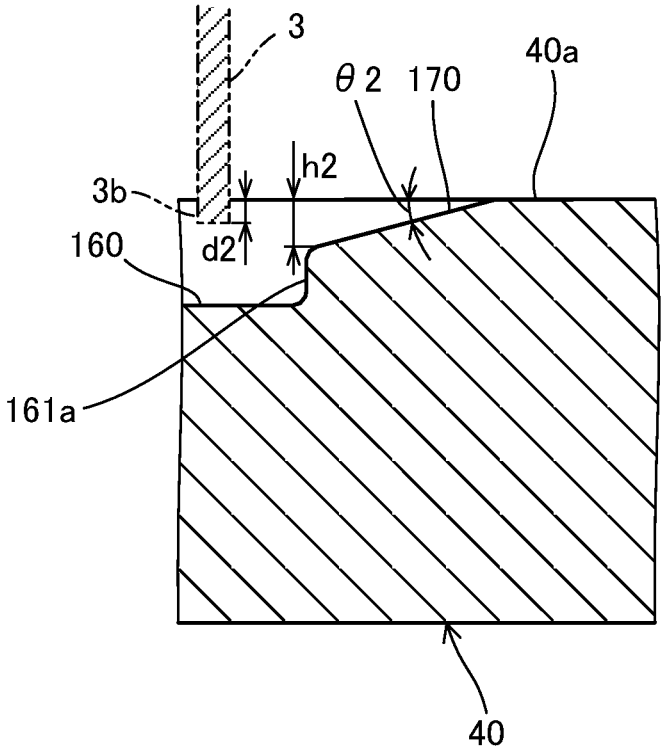
FIG. 10 is a sectional view taken along a line X-X in FIG. 3.

The base-end-side guide surfaces 170 that are provided correspondingly to the back pressure ports 160A will be described in detail with reference to FIGS. 3, 4, 9, and 10. FIG. 9 is a sectional view taken along a line IX-IX in FIG. 3, and FIG. 10 is a sectional view taken along a line X-X in FIG. 3. As shown in FIGS. 3, 4, 9, and 10, the base-end-side guide surfaces 170 are each provided on the end portion side of the back pressure port 160A in the circumferential direction that is the communication commencing side where the communication between the back pressure port 160A and the back pressure chambers 9 commences as the rotor 2 is forward rotated. The base-end-side guide surfaces 170 are each a flat surface that pushes the base-end portion 3*b* of the vane 3 upward and guides it toward the sliding contact surface 40*a* of the cover-side side plate 40 as the rotor 2 is rotated in the reverse rotation direction.

The back pressure ports 160A each has a main body portion 161 and a narrow-width portion 162 that is provided so as to extend from an end portion 161*a* of the main body portion 161 in the circumferential direction and that has a width in the radial direction that is narrower than that of the main body portion 161. The base-end-side guide surface 170 is provided so as to extend from the end portion 161*a* of the main body portion 161 in the circumferential direction and so as to be adjacent to the narrow-width portion 162.

As shown in FIG. 10, the end portion 161*a* of the main body portion 161 is provided so as to be parallel with the rotation axis of the rotor 2. The end portion 161*a* of the main body portion 161 is formed so as to be erected perpendicularly upward from a bottom surface of the back pressure port 160. The base-end-side guide surface 170 is formed to have a tapered shape in which the depth from the sliding contact surface 40*a* (the distance to the sliding contact surface 40*a* in the axial direction) is decreased in the reverse rotation direction of the rotor 2. The base-end-side guide surface 170 is linearly inclined toward the sliding contact surface 40*a* of the cover-side side plate 40 from an end portion of the end portion 161*a* on the opposite side of the bottom surface, in other words the end portion of the end portion 161*a* on the sliding contact surface 40*a* side (an upper end portion in the figure). The base-end-side guide surface 170 may be a tapered surface that is linearly inclined toward the sliding contact surface 40*a* from the end surface on the opposite side from the sliding contact surface 40*a* (the bottom surface of the back pressure port 160).

An axial direction distance h2 from a corner portion that forms the boundary between the end portion 161*a* of the main body portion 161 and the base-end-side guide surface 170 (in other words, the upper end portion of the end portion 161*a* of the main body portion 161 in the figure) to the sliding contact surface 40*a* is set so as to be greater than the maximum drop depth d2 of the vane 3 (in other words, the distance in the axial direction from the sliding contact surface 40*a* to the base-end portion 3*b* of the vane 3 that has dropped at the greatest extent) (h2>d2). For the base-end-side guide surface 170, it is preferable that an inclined angle θ2 relative to the sliding contact surface 40*a* be set so as to be greater than 0° and smaller than 45°.

Figure 11A:
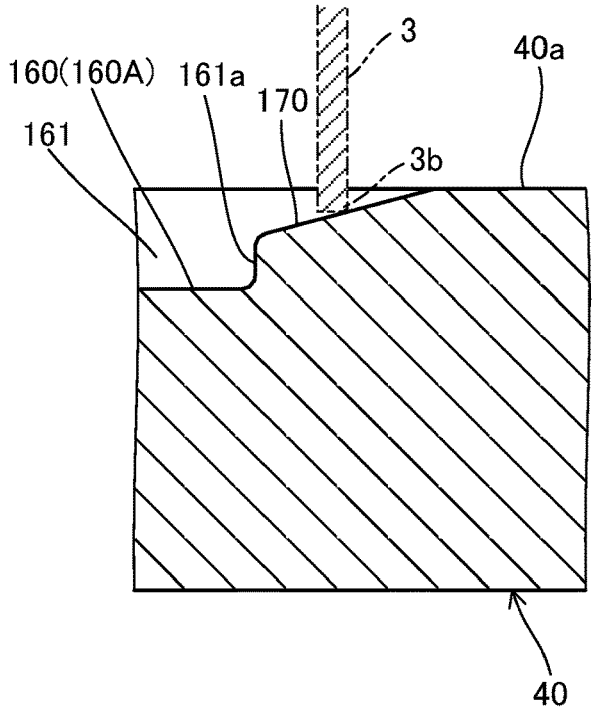
FIG. 11A is a diagram showing a state in which a base-end portion of the vane is in contact with a base-end-side guide surface.
Figure 11B:
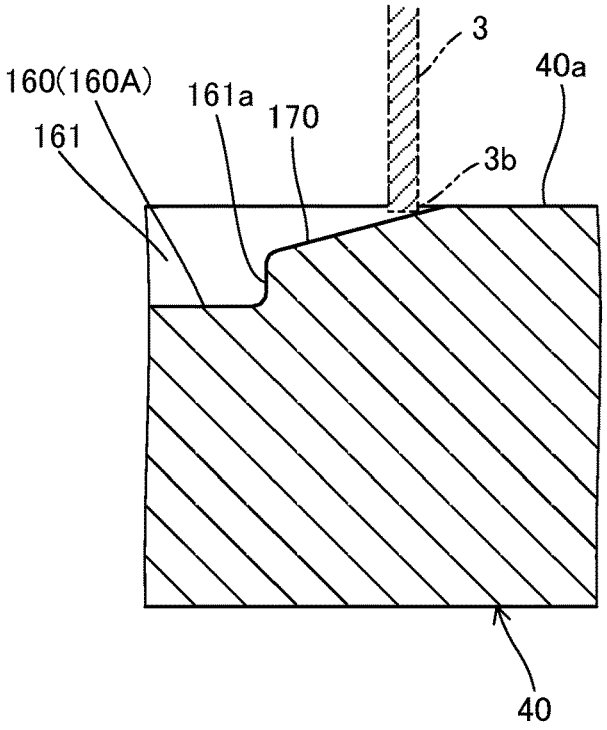
FIG. 11B is a diagram showing a state in which the base-end portion of the vane moves along the base-end-side guide surface.

Therefore, in a case in which the base-end portion 3*b* of the vane 3 has dropped into the back pressure port 160A when the vane pump 100 is reverse rotated, as shown in FIG. 11A, the base-end portion 3*b* of the vane 3 comes into contact with the base-end-side guide surface 170. As shown in FIG. 11B, together with the movement of the vane 3 in the circumferential direction, the base-end portion 3*b* of the vane 3 that has come into contact with the base-end-side guide surface 170 moves while being in sliding contact with the base-end-side guide surface 170. Because the base-end portion 3*b* of the vane 3 is pushed upward by the base-end-side guide surface 170, the inclination of the vane 3 is gradually corrected and the base-end portion 3*b* is guided to the sliding contact surface 40*a*. Because the base-end-side guide surface 170 is formed to have the tapered shape, the inclination of the vane 3 is corrected smoothly as the rotor 2 is reverse rotated.

Furthermore, the base-end-side guide surface 170 is linearly inclined. Thus, compared with a case in which the base-end-side guide surface 170 inclined so as to be curved, the sliding resistance of the base-end portion 3*b* of the vane 3 moving along the base-end-side guide surface 170 can be made constant, and so, it is possible to stably guide the base-end portion 3*b* of the vane 3 to the sliding contact surface 40*a* of the cover-side side plate 40.

In a case in which the base-end-side guide surface 170 is not provided, the base-end portion 3*b* of the vane 3 hits the end portion 161*a* perpendicularly erected from a bottom surface of the back pressure port 160A, and therefore, there is a risk of damage to the end portion 161*a*, such as chipping on the end portion 161*a*. In addition, the drop depth of the base-end portion 3*b* of the vane 3 on the inner side in the radial direction tends to be larger than that of the base-end portion 3*b* of the vane 3 on the outer side in the radial direction. In this embodiment, the base-end-side guide surface 170 is provided on the inner side of the back pressure port 160A in the radial direction. With such a configuration, the base-end portion 3*b* of the vane 3 that has dropped into the back pressure port 160A comes to contact with the base-end-side guide surface 170 and is guided to the sliding contact surface 40*a*, and therefore, it is possible to prevent the back pressure port 160A from being damaged.

As shown in FIGS. 3 and 4, each of the back pressure ports 160A is provided with the narrow-width portion 162 that extends from the end portion 161*a* of the main body portion 161 in the circumferential direction. Thus, by adjusting the length of the narrow-width portion 162 in the circumferential direction, it is possible to set, with a high accuracy, a range in the circumferential direction at which the communication with the back pressure chambers 9 is established, and therefore, it is possible to apply the back pressure to the vanes 3 evenly.

According to the above-described embodiment, following operational advantages can be achieved.

(1) The cover-side side plate 40 has the tip-end-side guide surfaces 130 that are each provided between the inner notch 20*i* and the outer notch 20*o* so as to be continuous from the end-portion-side arc portion 123*a* of the discharge port 42, the tip-end-side guide surface 130 being configured to push the tip end portion 3*a* of the vane 3 upward and guide it toward the sliding contact surface 40*a* of the cover-side side plate 40 as the rotor 2 is rotated in the reverse rotation direction. According to such a configuration, even in a case in which the vane pump 100 is reverse rotated and the tip end portion 3*a* of the vane 3 has dropped into the discharge port 42, the tip end portion 3*a* of the vane 3 can be guided to the sliding contact surface 40*a* of the cover-side side plate 40 along the tip-end-side guide surface 130, and therefore, it is possible to prevent the damage of the cover-side side plate 40 caused by the collision between the tip end portion 3*a* of the vane 3 and the cover-side side plate 40. Because the body-side side plate 30 is also provided with the tip-end-side guide surface 130 in a similar manner, it is possible to also prevent the damage of the body-side side plate 30 caused by the contact with the tip end portion 3*a* of the vane 3.

(2) The cover-side side plate 40 has the base-end-side guide surfaces 170 each provided on the end portion side of the back pressure port 160 on the communication commencing side where the communication with the back pressure chamber 9 commences as the rotor 2 is forward rotated, the base-end-side guide surface 170 being configured to push the base-end portion 3*b* of the vane 3 upward and guide it toward the sliding contact surface 40*a* of the cover-side side plate 40 as the rotor 2 is rotated in the reverse rotation direction. According to such a configuration, even in a case in which the base-end portion 3*b* of the vane 3 has dropped into the back pressure port 160 when the vane pump 100 is reverse rotated, the base-end portion 3*b* of the vane 3 can be guided to the sliding contact surface 40*a* of the cover-side side plate 40 along the base-end-side guide surface 170, and therefore, it is possible to prevent the damage of the cover-side side plate 40 caused by the collision between the base-end portion 3*b* of the vane 3 and the cover-side side plate 40. Because the body-side side plate 30 is also provided with the base-end-side guide surfaces 170 in a similar manner, it is possible to also prevent the damage of the body-side side plate 30 caused by the contact with the base-end portions 3*b* of the vanes 3.

Following modifications are also within the scope of the present invention, and it is also possible to combine the configurations shown in the modifications with the configurations described in the above-described embodiment, to combine the configurations described in the above-described different embodiments, and to combine the configurations described in the following different modifications.

<First Modification>

Figure 12A:
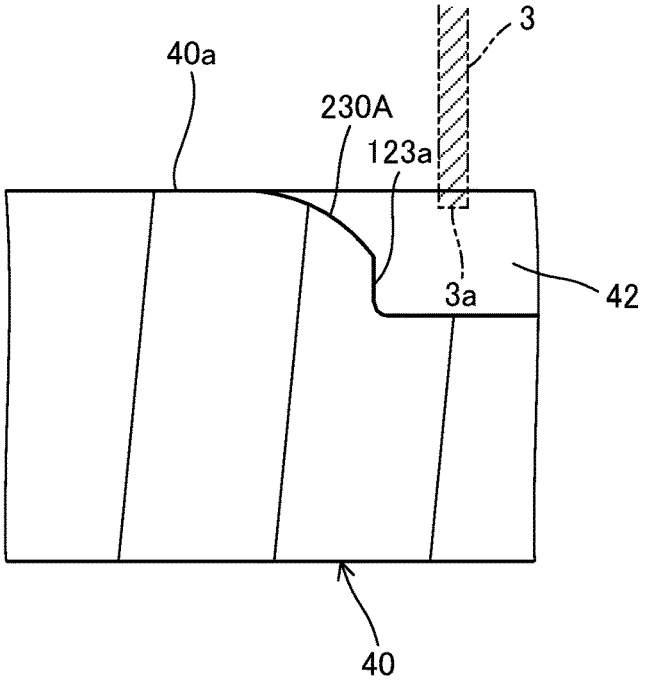
FIG. 12A is a sectional view showing an example of the tip-end-side guide surface that is formed so as to be curved.
Figure 12B:
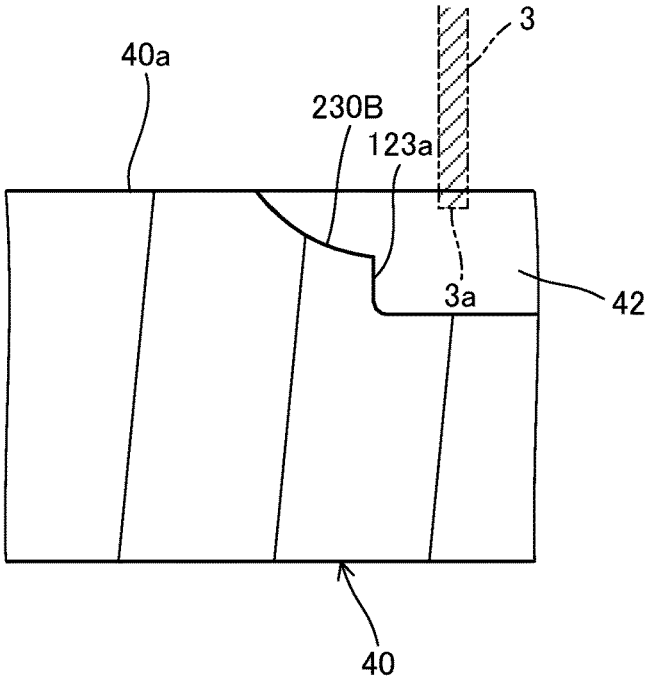
FIG. 12B is a sectional view showing another example of the tip-end-side guide surface that is formed so as to be curved.

In the above-mentioned embodiment, although a description has been given of an example in which the tip-end-side guide surface 130 and the base-end-side guide surface 170 have the linearly inclined tapered surface, the present invention is not limited to this configuration. As shown in FIGS. 12A and 12B, the tip-end-side guide surfaces 230A and 230B may have the tapered surface that is inclined so as to be curved. Similarly, the base-end-side guide surface 170 may have the tapered surface that is inclined so as to be curved.

<Second Modification>

In the above-mentioned embodiment, although a description has been given of an example in which the base-end-side guide surfaces 170 are each provided so as to be adjacent to the narrow-width portion 162 of the back pressure port 160, the present invention is not limited to this configuration. The narrow-width portion 162 may not be provided, and the base-end-side guide surface 170 may be provided so as to be continuous from the whole of the arc-shaped circumferential direction end portion of the back pressure port 160. In addition, in the above-mentioned embodiment, although a description has been given of an example in which the narrow-width portions 162 are provided on the outer side in the radial direction, and the base-end-side guide surfaces 170 are provided on the inner side in the radial direction, the arrangement relationship for the narrow-width portions 162 and the base-end-side guide surfaces 170 may be inverted.

<Third Modification>

In the above-mentioned embodiment, although a description has been given of an example in which the notches 20 are formed such that the opening area is gradually decreased in the direction opposite from the forward rotation direction of the rotor 2, the present invention is not limited to this configuration. For example, the notches 20 may be formed to have the groove shape whose opening area is constant along the rotation direction of the rotor 2.

<Fourth Modification>

In the above-mentioned embodiment, although a description has been given of an example in which the outer notches 20*o* are formed so as to be longer than the inner notches 20*i* in the circumferential direction, the present invention is not limited to this configuration. The inner notches 20*i* may be formed so as to be longer than the outer notches 20*o* in the circumferential direction.

<Fifth Modification>

The communicating groove 140 through which the back pressure port 160A and the back pressure port 160B are communicated may be provided with a base-end-side guide surface that pushes the base-end portion 3*b* of the vane 3 upward and guide it toward the sliding contact surface 40*a*. The communicating groove 140 provided with the base-end-side guide surface may be formed so as to extend along an outer edge of the back pressure port 160A and the back pressure port 160B on the inner circumferential side, or the communicating groove 140 may be formed so as to extend along the outer edge of the back pressure port 160A and the back pressure port 160B on the outer circumferential side.

<Sixth Modification>

In the above-described embodiment, although a description has been given of an example in which the tip-end-side guide surface 130 and the base-end-side guide surface 170 are formed on both of the cover-side side plate 40 and the body-side side plate 30, the present invention is not limited to this configuration. The tip-end-side guide surface 130 and the base-end-side guide surface 170 may be formed on either one of the cover-side side plate 40 and the body-side side plate 30.

<Seventh Modification>

In the above-described embodiment, although a description has been given of the vane pump 100 having the configuration in which the cam ring 4 and the rotor 2 are clamped by the pair of side plates 30 and 40, as an example, the present invention is not limited to this configuration. For example, it may possible to employ a configuration in which the side plate 40 may be omitted, and the rotor 2 and the vanes 3 are brought into sliding contact with the pump cover 50. In this case, the pump cover 50 functions as the side member. Thus, by forming the tip-end-side guide surface and the base-end-side guide surface in the pump cover 50, it is possible to prevent the pump cover 50 from being damaged by preventing the collision of the vanes 3 and the opening portions opening in the sliding contact surface of the pump cover 50.

The configurations, operations, and effects of the embodiment of the present invention configured as described above will be collectively described.

The vane pump 100 has: the rotor 2 having the plurality of slits 2*a* formed in a radiating pattern, the rotor 2 being rotationally driven; the plurality of vanes 3 freely slidably received in the slits 2*a*; the cam ring 4 having the cam face 4*a* with which the tip end portions 3*a* of the vanes 3 come into sliding contact; the side member (the body-side side plate 30, the cover-side side plate 40) having the sliding contact surface 30*a*, 40*a* with which the side surfaces of the rotor 2 and the vanes 3 come into sliding contact; the pump chambers 6 defined by the rotor 2, the cam ring 4, and the adjacent vanes 3; the suction port 31, 41 configured to open in the sliding contact surface 30*a*, 40*a*, the suction port 31, 41 being configured to guide the working fluid to be sucked into the pump chambers 6; the discharge port 42 configured to open in the sliding contact surface 30*a*, 40*a*, the discharge port 42 being configured to guide the working fluid discharged from the pump chambers 6; the groove-shaped notches 20 provided in the side member (the body-side side plate 30, the cover-side side plate 40) so as to extend from the end portion of the discharge port 42 (the end-portion-side arc portion 123*a*) in the direction opposite from the forward rotation direction of the rotor 2; and the back pressure chambers 9 defined with the base-end portions 3*b* of the vanes 3 in the slits 2*a*, wherein the notches 20 include: the inner notch 20*i* located at the inner side of the end portion of the discharge port 42 (the end-portion-side arc portion 123*a*) in the radial direction; and the outer notch 20*o* located at the outer side of the end portion of the discharge port 42 (the end-portion-side arc portion 123*a*) in the radial direction, and the side member (the body-side side plate 30, the cover-side side plate 40) has the tip-end-side guide surface 130, 230A, 230B provided between the inner notch 20*i* and the outer notch 20*o* so as to be continuous from the end portion of the discharge port 42 (the end-portion-side arc portion 123*a*), the tip-end-side guide surface 130, 230A, 230B being configured to push the tip end portion 3*a* of the vane 3 upward and guide it toward the sliding contact surface 30*a*, 40*a* of the side member (the body-side side plate 30, the cover-side side plate 40) as the rotor 2 is rotated in the reverse rotation direction.

In this configuration, even in a case in which the tip end portion 3*a* of the vane 3 has dropped into the discharge port 42 when the vane pump 100 is reverse rotated, the tip end portion 3*a* of the vane 3 can be guided to the sliding contact surface 30*a*, 40*a* of the side member (the body-side side plate 30, the cover-side side plate 40) along the tip-end-side guide surface 130, 230A, 230B, and therefore, it is possible to prevent the damage of the side member (the body-side side plate 30, the cover-side side plate 40) caused by the collision between the tip end portion 3*a* of the vane 3 and the side member (the body-side side plate 30, the cover-side side plate 40).

In the vane pump 100, the tip-end-side guide surface 130, 230A, 230B is formed to have the tapered shape in which the depth from the sliding contact surface 30*a*, 40*a* is decreased in the reverse rotation direction of the rotor 2.

In this configuration, the inclination of the vane 3 is corrected smoothly as the rotor 2 is reverse rotated.

In the vane pump 100, the tip-end-side guide surface 130 is linearly inclined.

In this configuration, the sliding resistance of the tip end portion 3*a* of the vane 3 moving along the tip-end-side guide surface 130 can be made constant, and so, it is possible to stably guide the tip end portion 3*a* of the vane 3 to the sliding contact surface 30*a*, 40*a* of the side member (the body-side side plate 30, the cover-side side plate 40).

In the vane pump 100, the side member (the body-side side plate 30, the cover-side side plate 40) has: the back pressure port 160, 165 configured to open in the sliding contact surface 30*a*, 40*a* and to communicate with the back pressure chambers 9; and the base-end-side guide surface 170 provided on the end portion side of the back pressure port 160, 165 on the communication commencing side where the communication with the back pressure chambers 9 commences as the rotor 2 is forward rotated, the base-end-side guide surface 170 being configured to push the base-end portion 3*b* of the vane 3 upward and guide it toward the sliding contact surface 30*a*, 40*a* of the side member (the body-side side plate 30, the cover-side side plate 40) as the rotor 2 is rotated in the reverse rotation direction.

The vane pump 100 has: the rotor 2 having the plurality of slits 2*a* formed in a radiating pattern, the rotor 2 being rotationally driven; the plurality of vanes 3 freely slidably received in the slits 2*a*; the cam ring 4 having the cam face 4*a* with which the tip end portions 3*a* of the vanes 3 come into sliding contact; the side member (the body-side side plate 30, the cover-side side plate 40) having the sliding contact surface 30*a*, 40*a* with which the side surfaces of the rotor 2 and the vanes 3 come into sliding contact; the pump chambers 6 defined by the rotor 2, the cam ring 4, and the adjacent vanes 3; the suction port 31, 41 configured to open in the sliding contact surface 30*a*, 40*a*, the suction port 31, 41 being configured to guide the working fluid to be sucked into the pump chambers 6; the discharge port 42 configured to open in the sliding contact surface 30*a*, 40*a*, the discharge port 42 being configured to guide the working fluid discharged from the pump chambers 6; and the back pressure chambers 9 defined with the base-end portions 3*b* of the vanes 3 in the slits 2*a*, wherein the side member (the body-side side plate 30, the cover-side side plate 40) has: the back pressure port 160, 165 configured to open in the sliding contact surface 30*a*, 40*a*, the back pressure port 160, 165 being configured to communicate with the back pressure chambers 9; and the base-end-side guide surface 170 provided on the end portion side of the back pressure port 160, 165 on the communication commencing side where the communication with the back pressure chambers 9 commences as the rotor 2 is forward rotated, the base-end-side guide surface 170 being configured to push the base-end portions 3*b* of the vanes 3 upward and guide them toward the sliding contact surface 30*a*, 40*a* of the side member (the body-side side plate 30, the cover-side side plate 40) as the rotor 2 is rotated in the reverse rotation direction.

In these configurations, even in a case in which the base-end portion 3*b* of the vane 3 has dropped into the back pressure port 160, 165 when the vane pump 100 is reverse rotated, the base-end portion 3*b* of the vane 3 can be guided to the sliding contact surface 30*a*, 40*a* of the side member (the body-side side plate 30, the cover-side side plate 40) along the base-end-side guide surface 170, and therefore, it is possible to prevent the damage of the side member (the body-side side plate 30, the cover-side side plate 40) caused by the collision between the base-end portion 3*b* of the vane 3 and the side member (the body-side side plate 30, the cover-side side plate 40).

In the vane pump 100, the base-end-side guide surface 170 is formed to have the tapered shape in which the depth from the sliding contact surface 30*a*, 40*a* is decreased in the reverse rotation direction of the rotor 2.

In this configuration, the inclination of the vanes 3 is corrected smoothly as the rotor 2 is reverse rotated.

In the vane pump 100, the base-end-side guide surface 170 is linearly inclined.

In this configuration, the sliding resistance of the base-end portion 3*b* of the vane 3 moving along the base-end-side guide surface 170 can be made constant, and so, it is possible to stably guide the base-end portion 3*b* of the vane 3 to the sliding contact surface 30*a*, 40*a* of the side member (the body-side side plate 30, the cover-side side plate 40).

In the vane pump 100, the back pressure port 160A has: the main body portion 161; and the narrow-width portion 162 provided so as to extend from the end portion 161*a* of the main body portion 161 in the circumferential direction, the narrow-width portion 162 having the radial-direction width narrower than the radial-direction width of the main body portion 161, and the base-end-side guide surface 170 is provided so as to extend from the end portion 161*a* of the main body portion 161 in the circumferential direction and so as to be adjacent to the narrow-width portion 162.

In this configuration, by providing the narrow-width portion 162, it is possible to set, with a high accuracy, a range in the circumferential direction at which the communication with the back pressure chambers 9 is established.

Embodiments of the present invention were described above, but the above embodiments are merely examples of applications of the present invention, and the technical scope of the present invention is not limited to the specific constitutions of the above embodiments.

This application claims priority based on Japanese Patent Application No. 2018-206815 filed with the Japan Patent Office on Nov. 1, 2018, the entire contents of which are incorporated into this specification by reference.

The invention claimed is:

1. A vane pump comprising:

a rotor having a plurality of slits formed in a radiating pattern, the rotor being rotationally driven;

a plurality of vanes freely slidably received in the slits, each vane having a tip end portion and a base-end portion opposite to each other in a radial direction of the rotor;

a cam ring having a cam face with which the tip end portions of the vanes come into sliding contact;

a side member having a sliding contact surface with which side surfaces of the rotor and the vanes come into sliding contact;

pump chambers defined by the rotor, the cam ring, and adjacent vanes;

a suction port configured to open in the sliding contact surface, the suction port being configured to guide working fluid to be sucked into the pump chambers;

a discharge port configured to open in the sliding contact surface, the discharge port being configured to guide the working fluid discharged from the pump chambers;

groove-shaped notches provided in the side member so as to extend from an end portion of the discharge port in a reverse rotation direction of the rotor that is opposite to a forward rotation direction of the rotor; and back pressure chambers defined with the base-end portions of the vanes in the slits, wherein the notches includes:

an inner notch located at an inner side of the end portion of the discharge port in the radial direction; and an outer notch located at an outer side of the end portion of the discharge port in the radial direction, and the side member has:

a tip-end-side guide surface provided between the inner notch and the outer notch so as to be continuous from the end portion of the discharge port, the tip-end-side guide surface being configured to push the tip end portions of the vanes upward and guides them toward the sliding contact surface of the side member when the rotor rotates in the reverse rotation direction;

a back pressure port configured to open in the sliding contact surface and to communicate with the back pressure chambers; and a base-end-side guide surface provided at an end portion of a communication commencing side of the back pressure port where communication between the back pressure port and the back pressure chambers commences as the rotor rotates in the forward rotation direction, the base-end-side guide surface being configured to push the base-end portions of the vanes upward to guide them toward the sliding contact surface of the side member as the rotor rotates in the reverse rotation direction.

2. The vane pump according to claim 1, wherein the tip-end-side guide surface has a tapered shape in which a depth from the sliding contact surface progressively decreases in the reverse rotation direction of the rotor.

3. The vane pump according to claim 2, wherein the tip-end-side guide surface is linearly inclined.

4. The vane pump according to claim 1, wherein the base-end-side guide surface has a tapered shape in which a depth from the sliding contact surface progressively decreases in the reverse rotation direction of the rotor.

5. The vane pump according to claim 4, wherein the base-end-side guide surface is linearly inclined.

6. The vane pump according to claim 1,
wherein the back pressure port has:
a main body portion; and
a narrow-width portion extending from an end portion of the main body portion in a circumferential direction of the rotor, the narrow-width portion having a width that is narrower than a width of the main body portion in the radial direction, and
wherein the base-end-side guide surface extends from the end portion of the main body portion in the circumferential direction and is adjacent to the narrow-width portion.

7. A vane pump comprising:
a rotor having a plurality of slits formed in a radiating pattern, the rotor being rotationally driven;
a plurality of vanes freely slidably received in the slits, each vane having a tip end portion and a base-end portion opposite to each other in a radial direction of the rotor;
a cam ring having a cam face with which the tip end portions of the vanes come into sliding contact;
a side member having a sliding contact surface with which side surfaces of the rotor and the vanes come into sliding contact;
pump chambers defined by the rotor, the cam ring, and adjacent vanes;
a suction port configured to open in the sliding contact surface, the suction port being configured to guide working fluid to be sucked into the pump chambers;
a discharge port configured to open in the sliding contact surface, the discharge port being configured to guide the working fluid discharged from the pump chambers; and
back pressure chambers defined with the base-end portions of the vanes in the slits,
wherein
the side member has:
a back pressure port configured to open in the sliding contact surface, the back pressure port being configured to communicate with the back pressure chambers; and
a base-end-side guide surface provided at an end portion of a communication commencing side of the back pressure port where communication between the back pressure port and the back pressure chambers commences as the rotor rotates in a forward rotation direction, the base-end-side guide surface being configured to push the base-end portions of the vanes upward to guide them toward the sliding contact surface of the side member as the rotor rotates in a reverse rotation direction that is opposite to the forward rotation direction.

8. The vane pump according to claim 7,
wherein the back pressure port has:
a main body portion; and
a narrow-width portion provided extending from an end portion of the main body portion in a circumferential direction of the rotor, the narrow-width portion having a width that is narrower than a width of the main body portion in the radial direction, and
wherein the base-end-side guide surface extends from the end portion of the main body portion in the circumferential direction and is adjacent to the narrow-width portion.

9. The vane pump according to claim 7, wherein the base-end-side guide surface has a tapered shape in which a depth from the sliding contact surface progressively decreases in the reverse rotation direction of the rotor.

10. The vane pump according to claim 9, wherein the base-end-side guide surface is linearly inclined.

* * * * *